US007111832B2

(12) United States Patent
Inoue

(10) Patent No.: US 7,111,832 B2
(45) Date of Patent: Sep. 26, 2006

(54) MULTISTAGE PRESSURE CONDENSER

(75) Inventor: Koichi Inoue, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/948,326

(22) Filed: Sep. 24, 2004

(65) Prior Publication Data

US 2005/0034455 A1 Feb. 17, 2005

Related U.S. Application Data

(62) Division of application No. 10/288,471, filed on Nov. 6, 2002, now Pat. No. 6,814,345.

(30) Foreign Application Priority Data

Nov. 13, 2001 (JP) ..... 2001-347056

(51) Int. Cl.
*B01F 3/04* (2006.01)

(52) U.S. Cl. ..... 261/146; 261/113; 261/157; 261/DIG. 10

(58) Field of Classification Search ..... 261/113, 261/115, 118, 127, 146, 147, 149, 157, DIG. 10, 261/DIG. 76
See application file for complete search history.

(56) References Cited

U.S. PATENT DOCUMENTS

| | | | | |
|---|---|---|---|---|
| 2,643,052 | A | 6/1953 | Doyle | |
| 2,956,784 | A | 10/1960 | Parkinson | |
| 3,511,481 | A | 5/1970 | Daltry | |
| 3,698,476 | A | 10/1972 | Wyzalek et al. | |
| 3,817,323 | A | 6/1974 | Ebara et al. | |
| 3,834,133 | A | 9/1974 | Bow | |
| 4,288,393 | A | 9/1981 | Sekiguchi et al. | |
| 4,598,767 | A | 7/1986 | Saleh | |
| 5,083,606 | A | 1/1992 | Brown et al. | |
| 6,484,503 | B1 | 11/2002 | Raz | |
| 6,814,345 | B1 * | 11/2004 | Inoue | 261/146 |

FOREIGN PATENT DOCUMENTS

| | | |
|---|---|---|
| FR | 2 426 878 | 12/1979 |
| JP | 11-173768 | * 7/1999 |

* cited by examiner

*Primary Examiner*—Scott Bushey
(74) *Attorney, Agent, or Firm*—Oblon, Spivak, McClelland, Maier & Neustadt, P.C.

(57) ABSTRACT

Low-pressure-side condensate is subjected to convection heating while dripping in high-pressure-side steam, and to surface turbulent heat transfer due to a circulating flow caused by downflow condensate falling after overflowing. Thus, the temperature of the low-pressure-side condensate can be raised efficiently with satisfactory heat transfer. A bypass connecting pipe enables high-pressure-side condensate to bypass condensate of a reheat chamber and merge with the condensate while keeping a high temperature. Thus, heating of the low-pressure-side condensate is performed sufficiently, with a space for falling being minimized for compactness. Also, condensate in a high amount of heat exchange is fed toward a condensate pump. Hence, a multistage pressure condenser permitting compactness and increased efficiency of a power plant can be constructed.

5 Claims, 10 Drawing Sheets

MULTISTAGE PRESSURE CONDENSER

This application is a divisional application of, and claims priority to, application Ser. No. 10/288,471, filed on Nov. 6, 2002, now U.S. Pat. No. 6,814,345, issued on Nov. 9, 2004, the contents of which are herein incorporated in its entirety by reference. In addition, this application claims priority to Japanese Patent Application No. 2001-347056 filed on Nov. 13, 2001 including specification, claims, drawings and summary, which is also incorporated herein by reference in its entirety.

BACKGROUND OF THE INVENTION

1. Field of the Invention

This invention relates to a multistage pressure condenser which has a plurality of chambers under different pressures, and which is designed to merge and pressure-feed condensates accumulated in the plurality of chambers.

2. Description of the Related Art

With steam turbine equipment, steam which has finished its work is introduced from a turbine exhaust hood into a condenser, where it is condensed to form condensate. The condensate formed by condensation in the condenser is heated via a feed water heater, and then supplied to a boiler to be formed into steam for use as a drive source for a steam turbine.

When the condensate formed by condensation in the condenser is fed to the feed water heater, the higher the temperature of the condensate, the more advantage is obtained in the aspect of plant efficiency. Thus, a multistage pressure condenser comprising a plurality of chambers at different pressures has so far been used to heat low-pressure-side condensate with steam of a high pressure chamber, thereby imparting a high temperature to the condensate to be supplied to the boiler. Concretely, the low-pressure-side condensate is caused to fall freely as droplets or liquid films in high pressure steam, and heated by convection heating. The use of the multistage pressure condenser can also widen the temperature difference between the temperature of cooling water and the temperature of saturated steam and decrease the area of the heat transfer surface.

With the conventional multistage pressure condenser, low-pressure-side condensate is caused to fall freely as droplets or liquid films in high pressure steam, and heated by convection heating. Thus, the time for which the droplets or liquid films are present in high pressure steam is lengthened to perform efficient heating. To lengthen the time for which the droplets or liquid films of the low-pressure-side condensate are present in high pressure steam, however, there is need to increase the height of falling, thus impeding compactness. If the falling height is minimized for achieving compactness, heating is insufficient, causing disadvantage to the efficiency of the plant.

SUMMARY OF THE INVENTION

The present invention has been accomplished in consideration of the above circumstances. It is the object of the invention to provide a multistage pressure condenser capable of achieving both of compactness and increased plant efficiency.

To attain the above object, the present invention, in a first aspect, provides a multistage pressure condenser having a plurality of chambers at different pressures and adapted to merge and pressure-feed condensates accumulated in the plurality of chambers, comprising:

a reheat chamber, partitioned off with a pressure barrier in a lower portion of a low pressure chamber, as the chamber on a low pressure side, for introducing and accumulating low-pressure-side condensate;

high pressure steam introduction means for introducing high pressure steam within a high pressure chamber, as the chamber on a high pressure side, into the reheat chamber; and bypass means for merging high-pressure-side condensate bypassing the reheat chamber and the low-pressure-side condensate discharged from the reheat chamber to raise the temperature of the condensate.

According to the first aspect of the invention, the low-pressure-side condensate can be heated in the reheat chamber, and the high-pressure-side condensate can be merged with the low-pressure-side condensate without a drop in the temperature of the high-pressure-side condensate. As a result, the condensate in a high amount of heat exchange can be transported toward a condensate pump. Hence, a multistage pressure condenser achieving compactness and increased efficiency of a power plant can be constructed.

In a second aspect, the present invention provides a multistage pressure condenser having a plurality of chambers at different pressures and adapted to merge and pressure-feed condensates accumulated in the plurality of chambers, comprising:

a reheat chamber, partitioned off with a pressure barrier in a lower portion of a low pressure chamber, as the chamber on a low pressure side, for introducing and accumulating low-pressure-side condensate;

high pressure steam introduction means for introducing high pressure steam within a high pressure chamber, as the chamber on a high pressure side, into the reheat chamber;

low pressure condensate introduction means for introducing low pressure condensate into the reheat chamber; and circulating flow generation means for generating a circulating flow in the condensate in the reheat chamber to cause surface turbulent heat transfer, whereby heat transfer to the condensate by high-pressure-side steam is promoted.

According to the second aspect of the invention, because of convection heating in high-pressure-side steam and surface turbulent heat transfer due to a circulating flow, the low-pressure-side condensate undergoes satisfactory heat transfer in the reheat chamber, and rises in temperature efficiently. Consequently, there is no need to lengthen the time for which droplets dwell in the high pressure steam, and heating takes place efficiently. That is, heating of the low-pressure-side condensate is performed sufficiently, with the space for falling being minimized for compactness. Hence, it becomes possible to construct a multistage pressure condenser permitting compactness and increased efficiency of a power plant.

In the multistage pressure condenser, the circulating flow generation means may be constituted such that a flow-through hole, through which the low-pressure-side condensate flows downward, is provided in the pressure barrier, and that the circulating flow is generated in the condensate of the reheat chamber by the low-pressure-side condensate flowing downward through the flow-through hole.

In the multistage pressure condenser, moreover, the circulating flow generation means may be constituted such that a drip hole, through which the low-pressure-side condensate drips, is provided in the pressure barrier; a receiving member is provided within the reheat chamber for accumulating the low-pressure-side condensate dripping through the drip hole and allowing the low-pressure-side condensate to overflow;

and the circulating flow is generated in the condensate of the reheat chamber by the low-pressure-side condensate overflowing the receiving member.

Also, in the multistage pressure condenser, the circulating flow generation means may be constituted such that a flow-through slit, through which the low-pressure-side condensate flows downward, is provided in the pressure barrier; and the circulating flow is generated in the condensate of the reheat chamber by the low-pressure-side condensate which flows downward through the flow-through slit, with a reverse flow thereof being suppressed.

Also, in the multistage pressure condenser, the flow-through slit may have a length-to-width ratio of 5 or more.

Also, in the multistage pressure condenser, the circulating flow generation means may be agitation means for directly agitating the condensate accumulated in the reheat chamber to generate the circulating flow.

Also, in the multistage pressure condenser, the circulating flow generation means may be constituted such that a pipe extending toward the reheat chamber is provided in the pressure barrier; and the circulating flow is generated in the condensate of the reheat chamber by the low-pressure-side condensate flowing downward through the pipe.

Also, in the multistage pressure condenser, the condensate accumulated in the reheat chamber may be partitioned by a partition wall into a plurality of sites to promote the circulating flow.

Also, in the multistage pressure condenser, the circulating flow generation means may be constituted such that a flow-through portion, through which the low-pressure-side condensate passes, is provided in the pressure barrier; and a condensate reservoir is provided which has an opening portion at a higher position than the water surface of the condensate accumulated in the reheat chamber, in which the low-pressure-side condensate passing through the flow-through portion is accumulated in such a state as to cause a circulating flow, and which allows the low-pressure-side condensate overflowing the opening portion to generate the circulating flow in the condensate accumulated in the reheat chamber.

In a third aspect, the present invention provides a multistage pressure condenser having a plurality of chambers at different pressures and adapted to merge and pressure-feed condensates accumulated in the plurality of chambers, comprising a reheat chamber, partitioned off with a pressure barrier in a lower portion of a low pressure chamber, as the chamber on a low pressure side, for introducing and accumulating low-pressure-side condensate;

high pressure steam introduction means for introducing high-pressure-side steam within a high pressure chamber, as the chamber on a high pressure side, into the reheat chamber;

a drip hole provided in the pressure barrier for allowing the low-pressure-side condensate to drip therethrough;

a receiving member provided within the reheat chamber for accumulating the low-pressure-side condensate dripping through the drip hole and allowing the low-pressure-side condensate to overflow, so that a circulating flow is generated in the condensate of the reheat chamber by the low-pressure-side condensate overflowing the receiving member; and bypass means for merging high-pressure-side condensate bypassing the condensate of the reheat chamber and the condensate of the reheat chamber to raise the temperature of the condensate.

According to the third aspect of the invention, because of convection heating in high-pressure-side steam and surface turbulent heat transfer due to the circulating flow, the low-pressure-side condensate undergoes satisfactory heat transfer in the reheat chamber, and rises in temperature efficiently. Consequently, there is no need to lengthen the time for which droplets dwell in the high pressure steam, and heating takes place efficiently. That is, heating of the low-pressure-side condensate is performed sufficiently, with the space for falling being minimized for compactness. Moreover, the high-temperature-side condensate can be merged with the low-temperature-side condensate, without a drop in the temperature of the high-temperature-side condensate, and the condensate in a high amount of heat exchange can be transported toward a condensate pump. Hence, it becomes possible to construct a multistage pressure condenser permitting compactness and increased efficiency of a power plant.

In a fourth aspect, the present invention provides a multistage pressure condenser having a plurality of chambers at different pressures and adapted to merge and pressure-feed condensates accumulated in the plurality of chambers, comprising a reheat chamber, partitioned off with a pressure barrier in a lower portion of a low pressure chamber, as the chamber on a low pressure side, for introducing and accumulating low-pressure-side condensate;

high pressure steam introduction means for introducing high-pressure-side steam within a high pressure chamber, as the chamber on a high pressure side, into the reheat chamber; and a pipe provided in the pressure barrier and extending toward the reheat chamber, whereby a circulating flow is generated in the condensate of the reheat chamber by the low-pressure-side condensate flowing through the pipe, with the water level of the low-pressure-side condensate of the low pressure chamber being lowered.

According to the fourth aspect of the invention, because of convection heating in high-pressure-side steam and surface turbulent heat transfer due to the circulating flow, the low-pressure-side condensate undergoes satisfactory heat transfer in the reheat chamber, and rises in temperature efficiently, with the water level of the low-pressure-side condensate of the low pressure chamber being lowered. Hence, it becomes possible to construct a multistage pressure condenser enabling the low pressure chamber to be compact and the efficiency of a power plant to be increased.

In a fifth aspect, the present invention provides a multistage pressure condenser having a plurality of chambers at different pressures and adapted to merge and pressure-feed condensates accumulated in the plurality of chambers, comprising:

means for introducing low-pressure-side condensate into a high pressure chamber, the chamber on a high pressure side, and heating the low-pressure-side condensate with high-pressure-side steam.

According to the fifth aspect of the invention, the low-pressure-side condensate undergoes satisfactory heat transfer in the high pressure chamber by convection heating in high-pressure-side steam, and rises in temperature efficiently. Hence, it becomes possible to construct a multistage pressure condenser enabling the low pressure chamber to be compact and the efficiency of a power plant to be increased.

In the multistage pressure condenser, moreover, the means for heating may let the low-pressure-side condensate fall into the chamber on the high pressure side to generate a circulating flow in the condensate accumulated in the chamber on the high pressure side, catch condensate, which has been produced in a tube nest on the high pressure side, by a receiving member installed below the tube nest, and mix the caught condensate with the condensate, which has been accumulated in the chamber on the high pressure side, outside of the condenser.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Preferred embodiments of the present invention will now be described in detail with reference to the accompanying drawings, which in no way limit the invention.

Figure 1:
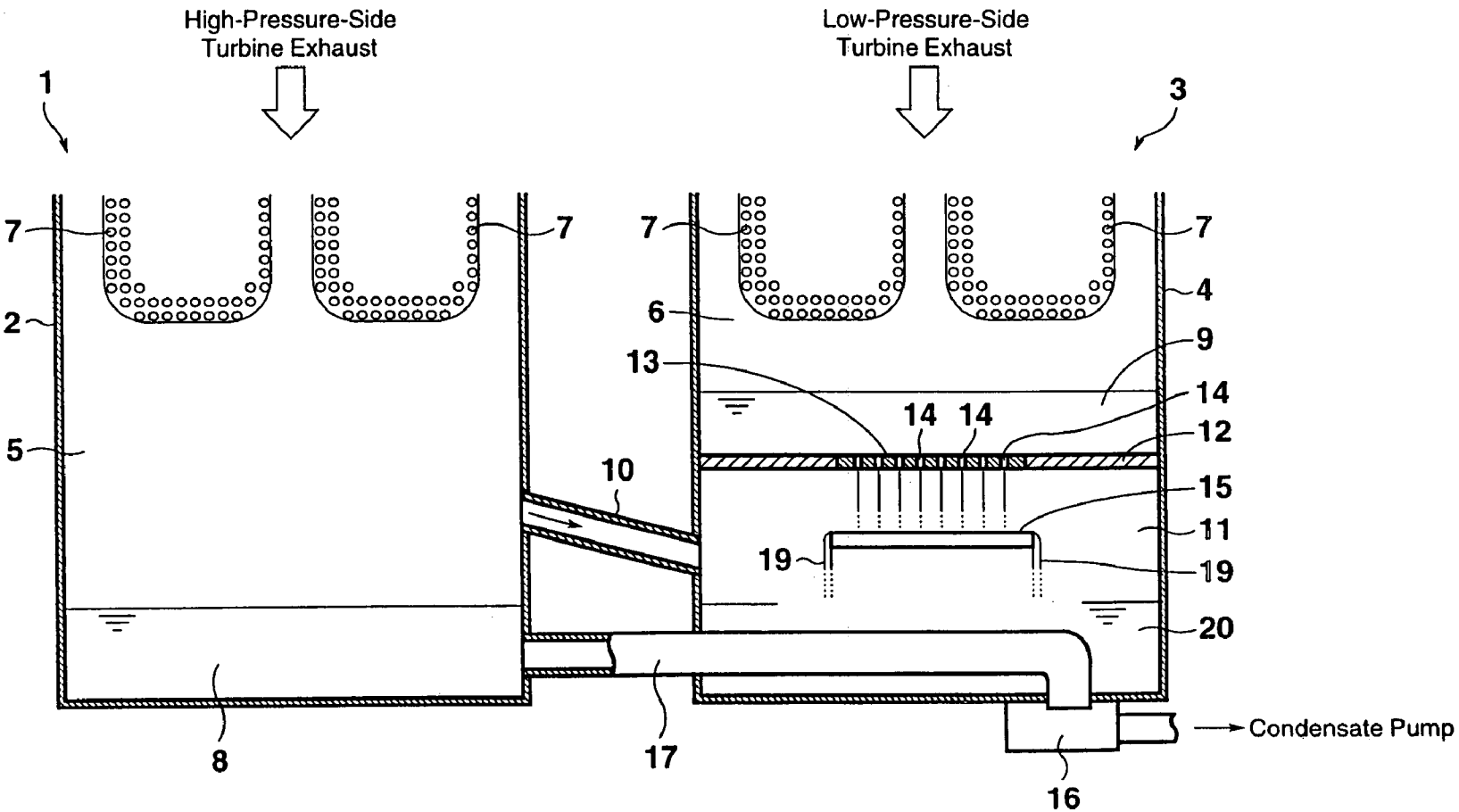
FIG. 1 is a sectional view showing the schematic configuration of a multistage pressure condenser according to a first embodiment of the present invention.
Figure 2:
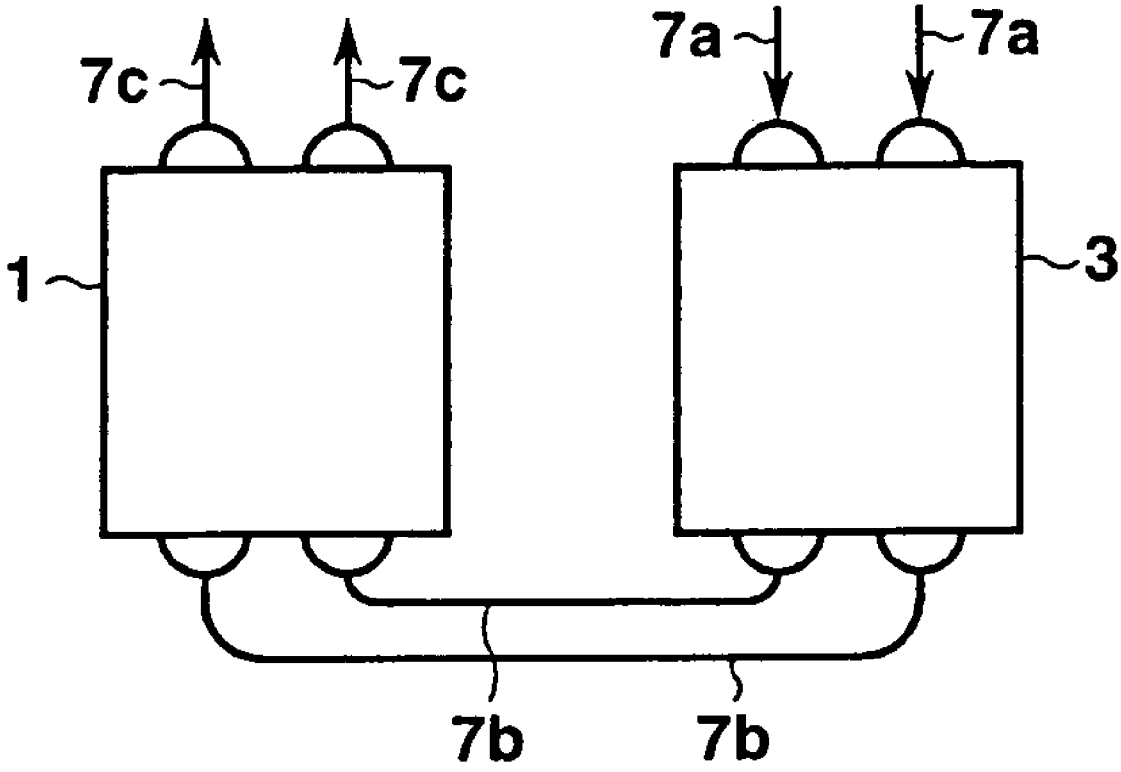
FIG. 2 is a plan view illustrating the flow status of cooling water.

FIG. 1 is a sectional view showing the schematic configuration of a multistage pressure condenser according to a first embodiment of the present invention. FIG. 2 is a plan view illustrating the flow status of cooling water.

A steam turbine is composed of a high-pressure-side steam turbine and a low-pressure-side steam turbine. As shown in FIG. 1, a high pressure shell 2 of a high pressure stage condenser 1 is connected to an outlet side for exhaust steam of the high-pressure-side steam turbine, while a low pressure shell 4 of a low pressure stage condenser 3 is connected to an outlet side for exhaust steam of the low-pressure-side steam turbine. A high pressure chamber 5, a chamber on a high pressure side, is formed by the high pressure shell 2 of the high pressure stage condenser 1. Whereas a low pressure chamber 6, a chamber on a low pressure side, is formed by the low pressure shell 4 of the low pressure stage condenser 3.

The high pressure chamber 5 and the low pressure chamber 6 are each provided with cooling water tube nests 7. As shown in FIG. 2, seawater, for example, is introduced as cooling water into the cooling water tube nests 7 of the low pressure chamber 6 through introduction pipes 7*a*, transported from the cooling water tube nests 7 of the low pressure chamber 6 to the cooling water tube nests 7 of the high pressure chamber 5 via connecting pipes 7*b*, and discharged through discharge pipes 7*c*. Exhaust steam, which has finished its work in the steam turbine, is fed to the high pressure chamber 5 and the low pressure chamber 6. Then, the exhaust steam is condensed by cooling water flowing in each of the cooling water tube nests 7 to become high-pressure-side condensate 8 for accumulation in the high pressure chamber 5, and also to become low-pressure-side condensate 9 for accumulation in the low pressure chamber 6.

A reheat chamber 11 is provided in the low pressure shell 4 in a lower portion of the low pressure chamber 6, and the low pressure chamber 6 and the reheat chamber 11 are separated by a pressure barrier 12. The high pressure chamber 5 and the reheat chamber 11 are connected by a steam duct 10, and high-pressure-side steam within the high pressure chamber 5 is fed into the reheat chamber 11 through the steam duct 10. The pressure barrier 12 is provided with a perforated plate 13, and many holes 14 as drip holes are formed in the perforated plate 13. A tray 15, as a receiving member, is provided in the reheat chamber 11 below the perforated plate 13, and the tray 15 is fed with drops of (is sprinkled with) the low-pressure-side condensate 9 through the holes 14. The condensate caught onto the tray 15 overflows, and falls for accumulation as condensate 20 in the reheat chamber 11. A circulating flow occurs in the condensate 20, which has been accumulated in the reheat chamber 11 because of downflow condensate 19 falling after overflowing the tray 15. As a result, surface turbulent heat transfer takes place on the surface of the condensate 20.

A merger portion 16 is provided below the reheat chamber 11, and a bypass connecting pipe 17, as bypass means, leads from the high pressure chamber 5 to the merger portion 16. The bypass connecting pipe 17 is preferably made of a material having a heat insulating structure. The bypass connecting pipe 17 guides the high-pressure-side condensate 8 into the merger portion 16, while minimizing its drop in temperature, to merge it with the condensate 20. The condensate 20 and the high-pressure-side condensate 8, which have been merged in the merger portion 16, are transported toward a condensate pump, and transported toward a boiler via a feed water heater, etc. The high-pressure-side condensate 8 is merged while bypassing the condensate 20 of the reheat chamber 11. Thus, the condensate 20 is mixed with the high-pressure-side condensate 8 kept at a high temperature, so that the high temperature condensate can be transported toward the condensate pump.

With the so configured multistage pressure condenser, exhaust steam having finished its work in the steam turbine is fed into the high pressure chamber 5 and the low pressure chamber 6. The exhaust steam is condensed by the cooling water tube nests 7, and accumulated in the high pressure chamber 5 as the high-pressure-side condensate 8 on one hand, and in the low pressure chamber 6 as the low-pressure-side condensate 9 on the other hand. The low-pressure-side condensate 9, accumulated in the low pressure chamber 6, is drip-fed onto the tray 15 of the reheat chamber 11 through the holes 14 of the perforated plate 13, and accumulated there. High-pressure-side steam within the high pressure chamber 5 is fed into the reheat chamber 11 via the steam duct 10. Thus, the low-pressure-side condensate 9, fed in drops onto the tray 15, is drip-fed in the high-pressure-side steam and heated by convection heating. Downflow condensate 19, i.e., the condensate overflowing the tray 15 and falling, causes a circulating flow to the condensate 20 accumulated in the reheat chamber 11. The circulating condensate 20 contacts the fed high-pressure-side steam over a wide area, undergoing surface turbulent heat transfer.

By these actions, the low-pressure-side condensate 9 is subjected to surface turbulent heat transfer while flowing downward in the high-pressure-side steam, and to surface turbulent heat transfer due to the circulating flow caused by the downflow condensate 19, the condensate that has overflowed and fallen. As a result, satisfactory heat transfer takes place to raise the temperature of the condensate efficiently. Consequently, heating is carried out efficiently, without the need to lengthen the time for which droplets dwell in the high pressure steam. That is, heating of the low-pressure-side condensate 9 is performed sufficiently, with the space for falling being minimized for compactness. Hence, it becomes possible to construct a multistage pressure condenser permitting compactness and increased efficiency of a power plant.

Moreover, the bypass connecting pipe 17 enables the high-pressure-side condensate 8 to merge while bypassing the condensate 20 of the reheat chamber 11. Thus, the high-pressure-side condensate 8, kept at a high temperature, is mixed with the condensate 20, so that the condensate at a high temperature can be transported toward the condensate pump. The water surface temperature of the condensate 20 accumulated in the reheat chamber 11 can be prevented from becoming high, and the amount of heat transferred during surface turbulent heat transfer at the time of contact with the high-pressure-side steam on the water surface can be maximized.

Figure 3:
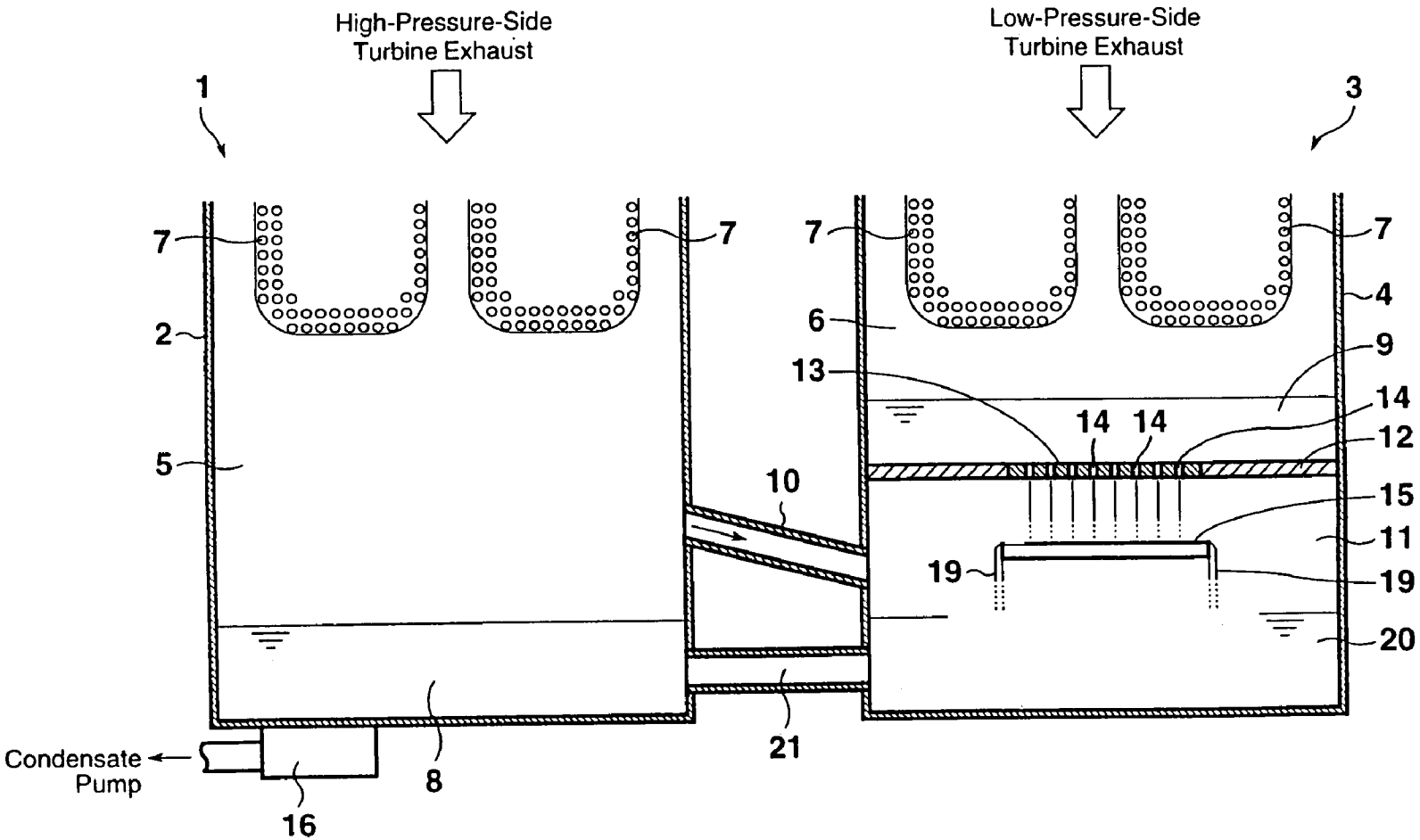
FIG. 3 is a sectional view showing the schematic configuration of a multistage pressure condenser according to a second embodiment of the present invention.

A second embodiment of the present invention will be described with reference to FIG. 3. FIG. 3 shows a section depicting the schematic configuration of a multistage pressure condenser according to the second embodiment of the present invention. The same members as the members shown in FIG. 1 are assigned the same numerals, and duplicate explanations are omitted.

The multistage pressure condenser shown in FIG. 3 is different from the multistage pressure condenser shown in FIG. 1 in the construction for mixing the high-pressure-side condensate 8 with the condensate 20. That is, as shown in FIG. 3, a connecting pipe 21 connecting the high pressure chamber 5 and the reheat chamber 11 is provided instead of the bypass connecting pipe 17. Condensate 20 is transported to the high pressure chamber 5 via the connecting pipe 21, and mixed with high-pressure-side condensate 8 in the high pressure chamber 5.

Thus, the pipe line is simplified, the space surrounding the low pressure stage condenser 3 is decreased, and the degree of freedom to design the merger portion 16, etc. is increased.

Figure 4:
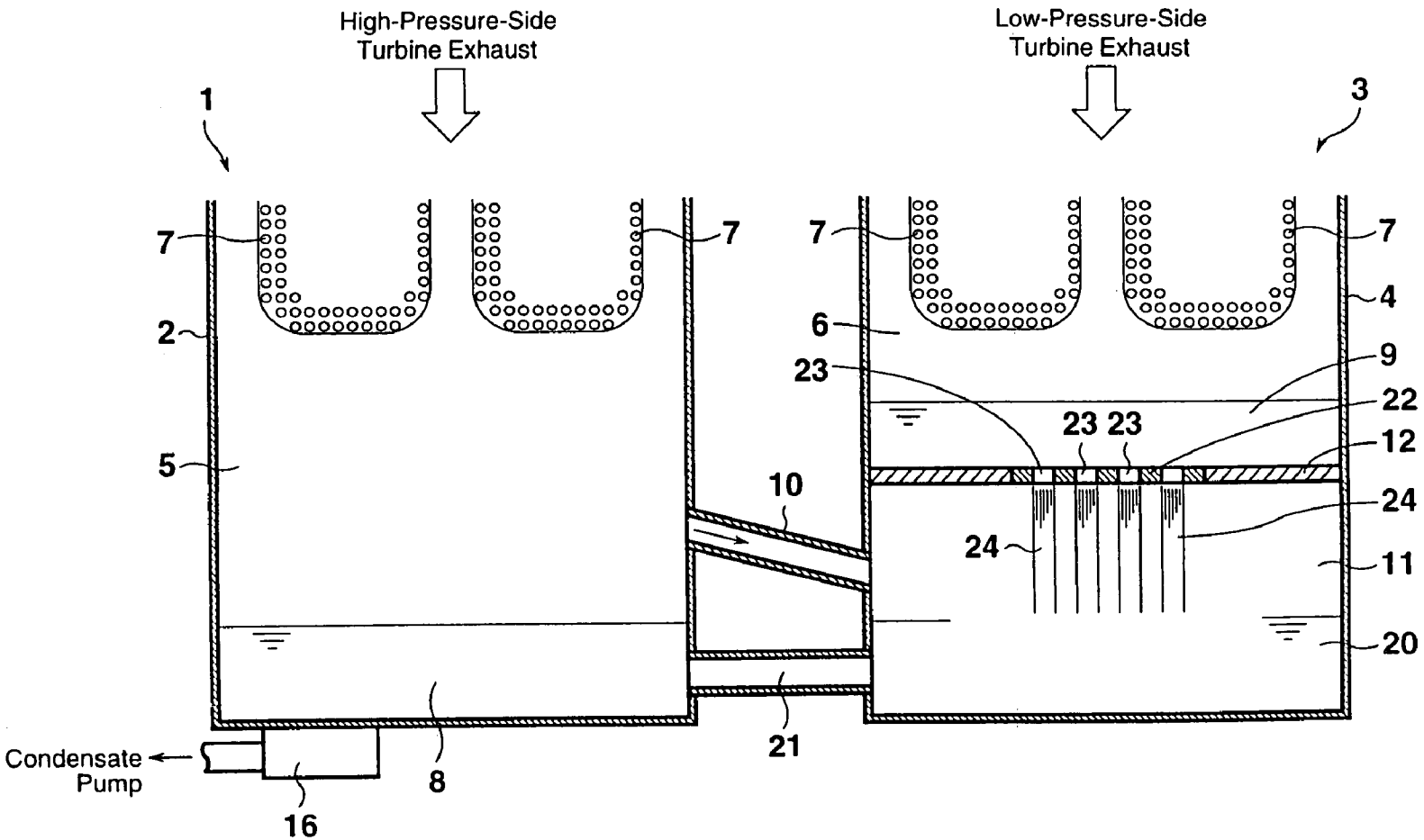
FIG. 4 is a sectional view showing the schematic configuration of a multistage pressure condenser according to a third embodiment of the present invention.

A third embodiment of the present invention will be described with reference to FIG. 4. FIG. 4 shows a section depicting the schematic configuration of a multistage pressure condenser according to the third embodiment of the present invention. The same members as the members shown in FIG. 3 are assigned the same numerals, and duplicate explanations are omitted.

The multistage pressure condenser shown in FIG. 4 is different from the multistage pressure condenser shown in FIG. 3 in the construction for introducing the low-pressure-side condensate 9 accumulated in the low pressure chamber 6 into the reheat chamber 11. That is, the pressure barrier 12 is provided with a bored plate 22 instead of the perforated plate 13, and the bored plate 22 is provided with flow-through holes 23 through which the low-pressure-side condensate 9 flows downward. The low-pressure-side condensate 9 flows downward through the flow-through holes 23, changing into downflow condensate 24. The downflow condensate 24 directly falls onto condensate 20 accumulated in the reheat chamber 11, causing a circulating flow. High-pressure-side steam fed contacts the surface of the condensate 20 over a wide area, causing surface turbulent heat transfer. The number and the diameter of the flow-through holes 23 is set, as desired, according to the pressure of the low pressure chamber 6 or the pressure of the reheat chamber 11.

Thus, the member for causing a circulating flow to the condensate 20 accumulated in the reheat chamber 11, i.e., tray 15, is unnecessary, making it possible to shrink the reheat chamber 11 and make the low pressure stage condenser 3 compact. It is also possible to adopt a construction in which the pressure barrier 12 having the bored plate 22 is used in the multistage pressure condenser shown in FIG. 1.

Figure 5:
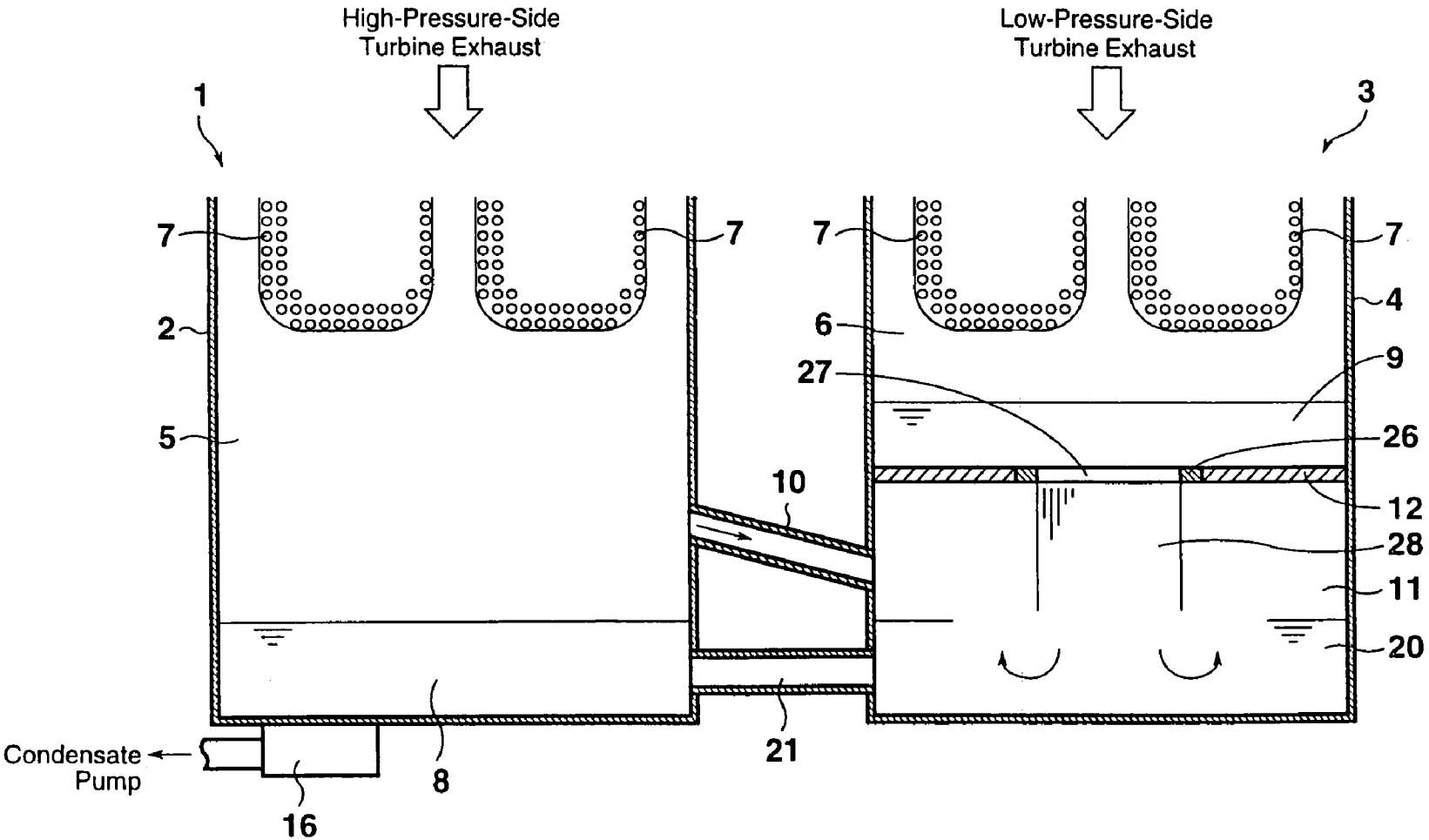
FIG. 5 is a sectional view showing the schematic configuration of a multistage pressure condenser according to a fourth embodiment of the present invention.
Figure 6:
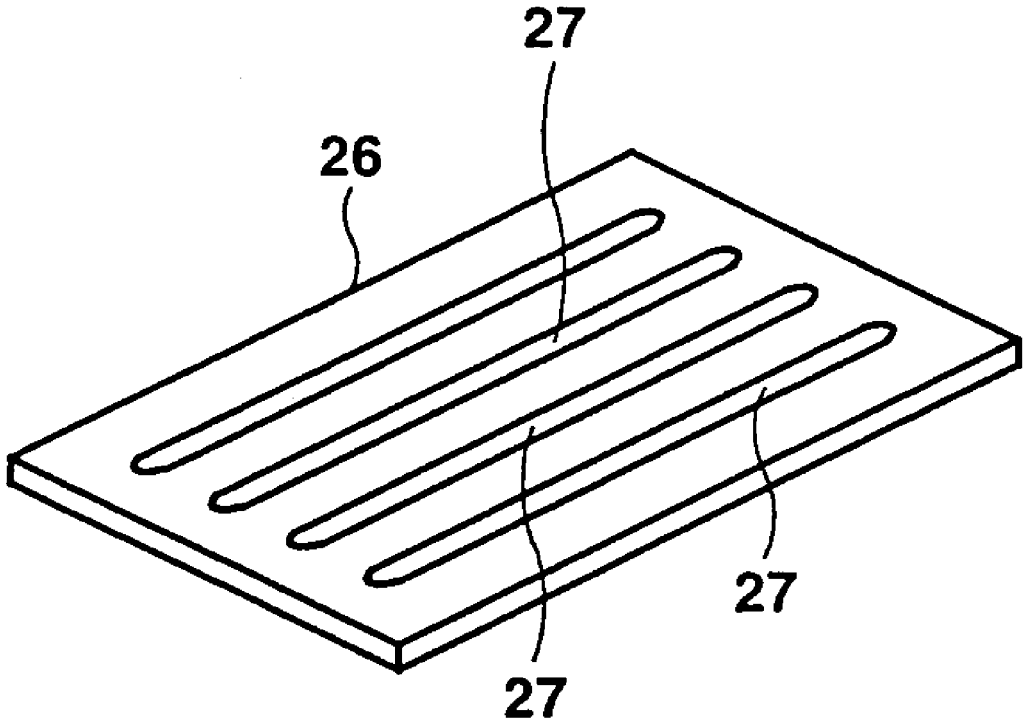
FIG. 6 is a perspective view of a slit plate.

A fourth embodiment of the present invention will be described with reference to FIGS. 5 and 6. FIG. 5 shows a section depicting the schematic configuration of a multistage pressure condenser according to the fourth embodiment of the present invention. FIG. 6 shows, in perspective, a slit plate. The same members as the members shown in FIG. 3 are assigned the same numerals, and duplicate explanations are omitted.

The multistage pressure condenser shown in FIG. 5 is different from the multistage pressure condenser shown in FIG. 3 in the construction for introducing the low-pressure-side condensate 9 accumulated in the low pressure chamber 6 into the reheat chamber 11. That is, the pressure barrier 12 is provided with a slit plate 26 instead of the perforated plate 13, and the slit plate 26 is provided with flow-through slits 27 through which the low-pressure-side condensate 9 flows downward in a filmy form. The low-pressure-side condensate 9 flows downward as films through the flow-through slits 27, changing into downflow condensate 28. The downflow condensate 28 directly falls, like bands, onto condensate 20 accumulated in the reheat chamber 11, causing a circulating flow. High-pressure-side steam fed contacts the surface of the condensate 20 over a wide area, causing surface turbulent heat transfer. The flow-through slit 27 has a slit length-to-width ratio of 5 or more for letting the condensate flow downward in a filmy form.

Thus, the member for causing a circulating flow to the condensate 20 accumulated in the reheat chamber 11, i.e., tray 15, is unnecessary, making it possible to shrink the reheat chamber 11 and make the low pressure stage condenser 3 compact. It is also possible to adopt a construction in which the pressure barrier 12 having the slit plate 26 is used in the multistage pressure condenser shown in FIG. 1.

Figure 7:
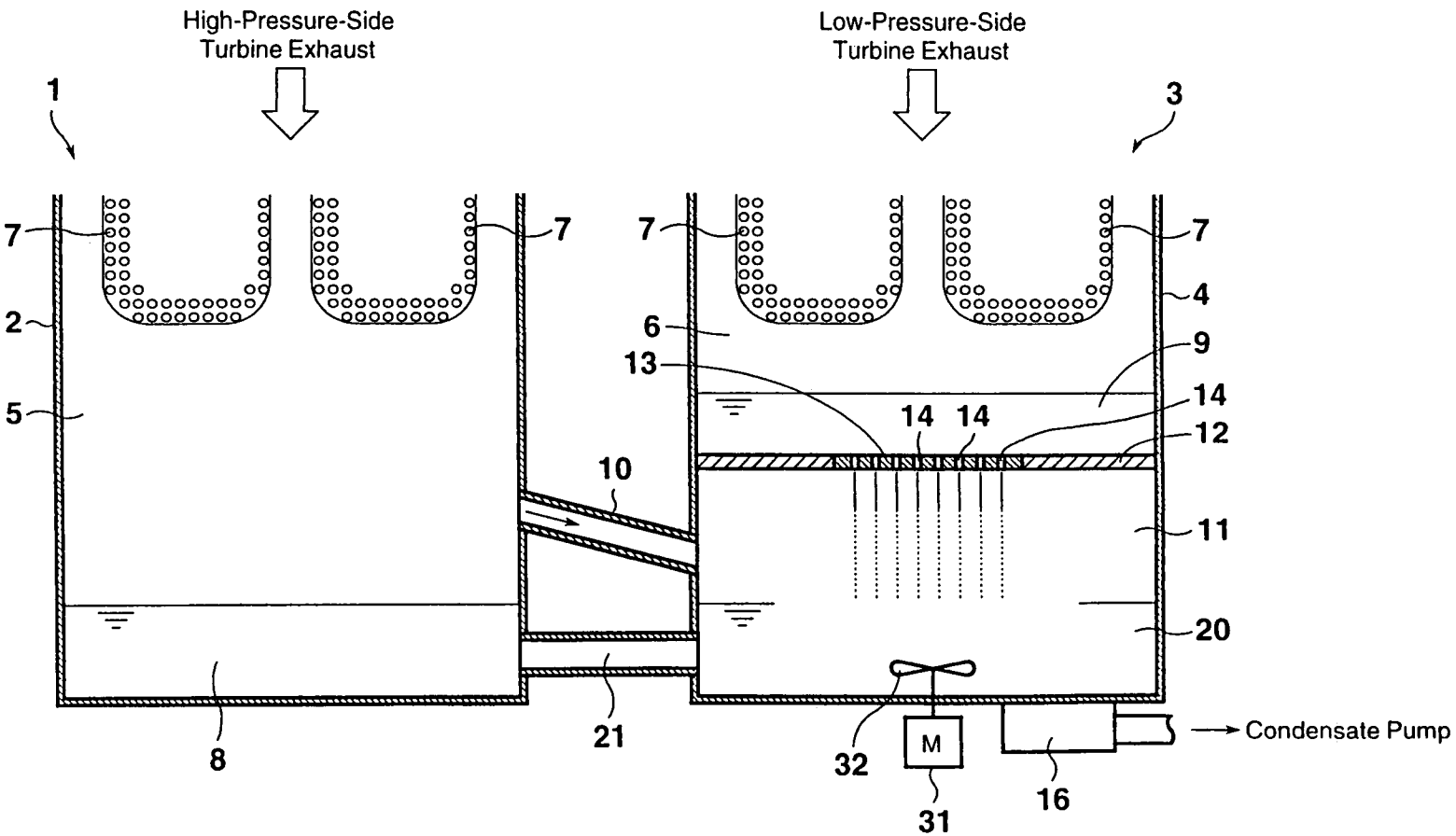
FIG. 7 is a sectional view showing the schematic configuration of a multistage pressure condenser according to a fifth embodiment of the present invention.

A fifth embodiment of the present invention will be described with reference to FIG. 7. FIG. 7 shows a section depicting the schematic configuration of a multistage pressure condenser according to the fifth embodiment of the present invention. The same members as the members shown in FIG. 3 are assigned the same numerals, and duplicate explanations are omitted.

The multistage pressure condenser shown in FIG. 7 is different from the multistage pressure condenser shown in FIG. 3 in the construction for causing a circulating flow to condensate 20 accumulated in the reheat chamber 11. That is, an agitation screw 32 to be rotated by a motor 31 is disposed, as agitation means, within condensate 20 accumulated in the reheat chamber 11. The low-pressure-side condensate 9 drips through the holes 14 of the perforated plate 13, and is accumulated unchanged in the reheat chamber 11, becoming condensate 20. The condensate 20 is directly agitated by the rotation of the agitation screw 32 to cause a circulating flow. High-pressure-side steam fed contacts the surface of the condensate 20 over a wide area, causing surface turbulent heat transfer.

Thus, the member for causing a circulating flow to the condensate 20 accumulated in the reheat chamber 11, i.e., tray 15, is unnecessary, making it possible to shrink the reheat chamber 11 and make the low pressure stage condenser 3 compact. It is also possible to add the agitation means to any of the multistage pressure condensers shown in FIGS. 1 to 6.

Figure 8:
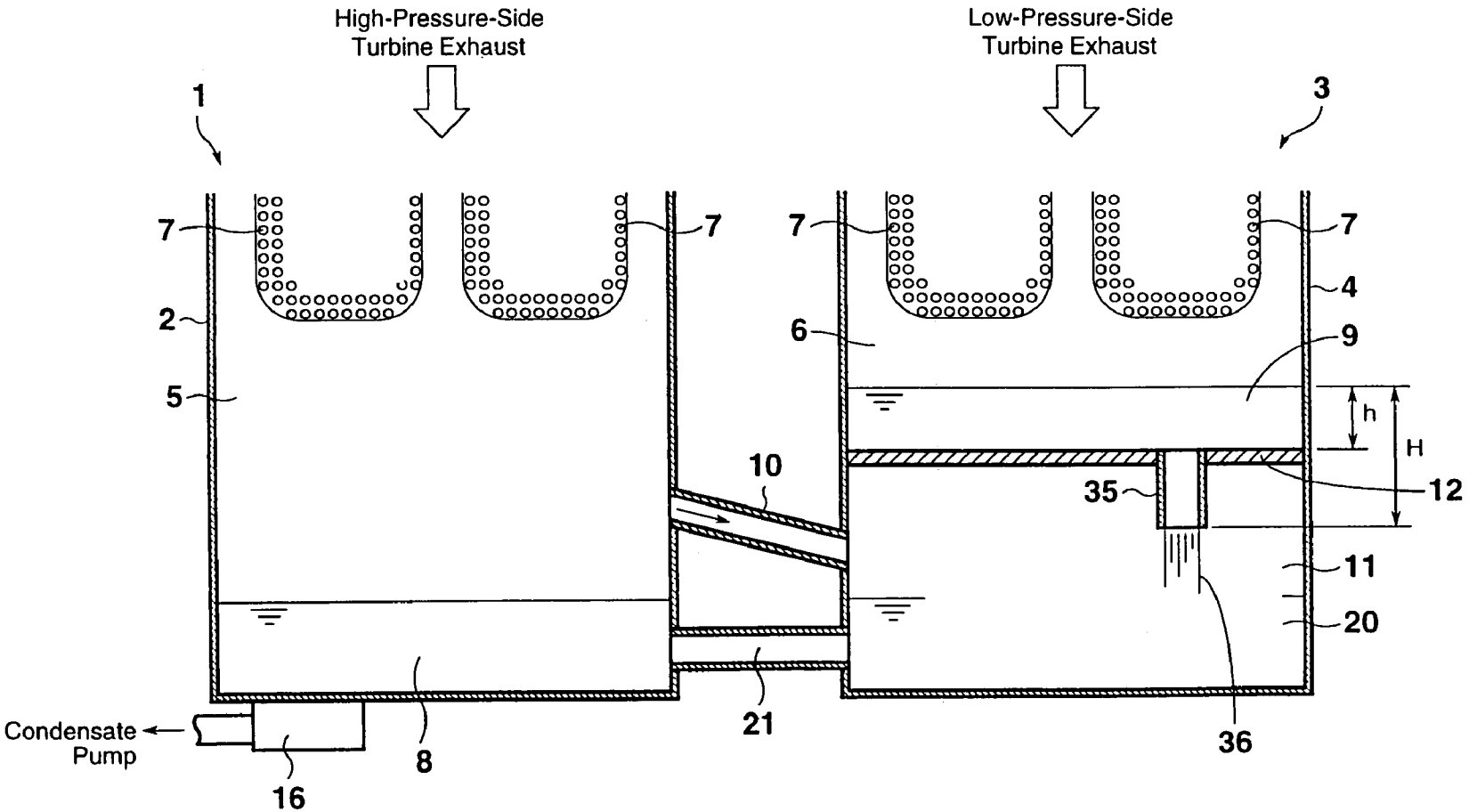
FIG. 8 is a sectional view showing the schematic configuration of a multistage pressure condenser according to a sixth embodiment of the present invention.

A sixth embodiment of the present invention will be described with reference to FIG. 8. FIG. 8 shows a section depicting the schematic configuration of a multistage pressure condenser according to the sixth embodiment of the present invention. The same members as the members shown in FIG. 3 are assigned the same numerals, and duplicate explanations are omitted.

The multistage pressure condenser shown in FIG. 8 is different from the multistage pressure condenser shown in FIG. 3 in the construction for introducing the low-pressure-side condensate 9 accumulated in the low pressure chamber 6 into the reheat chamber 11. That is, the pressure barrier 12 is provided with a pipe 35, which extends toward the reheat chamber 11, instead of the perforated plate 13. The low-pressure-side condensate 9 fills the pipe 35 to the full, and flows downward, changing into downflow condensate 36. The downflow condensate 36 increases in flow velocity, directly falls onto condensate 20 accumulated in the reheat chamber 11, causing a circulating flow. High-pressure-side steam fed contacts the surface of the condensate 20 over a wide area, causing surface turbulent heat transfer.

In any of the above-described multistage pressure condensers of the first to sixth embodiments, the condensate 20 of the reheat chamber 11 can be partitioned by partition walls into a plurality of sites to suppress mixing of the condensate 20 in the respective sites. By suppressing the mixing of the condensate 20, the circulating flow is generated in a narrow range to promote the formation of the circulating flow. Thus, surface turbulent heat transfer can be performed more effectively.

Figure 9:
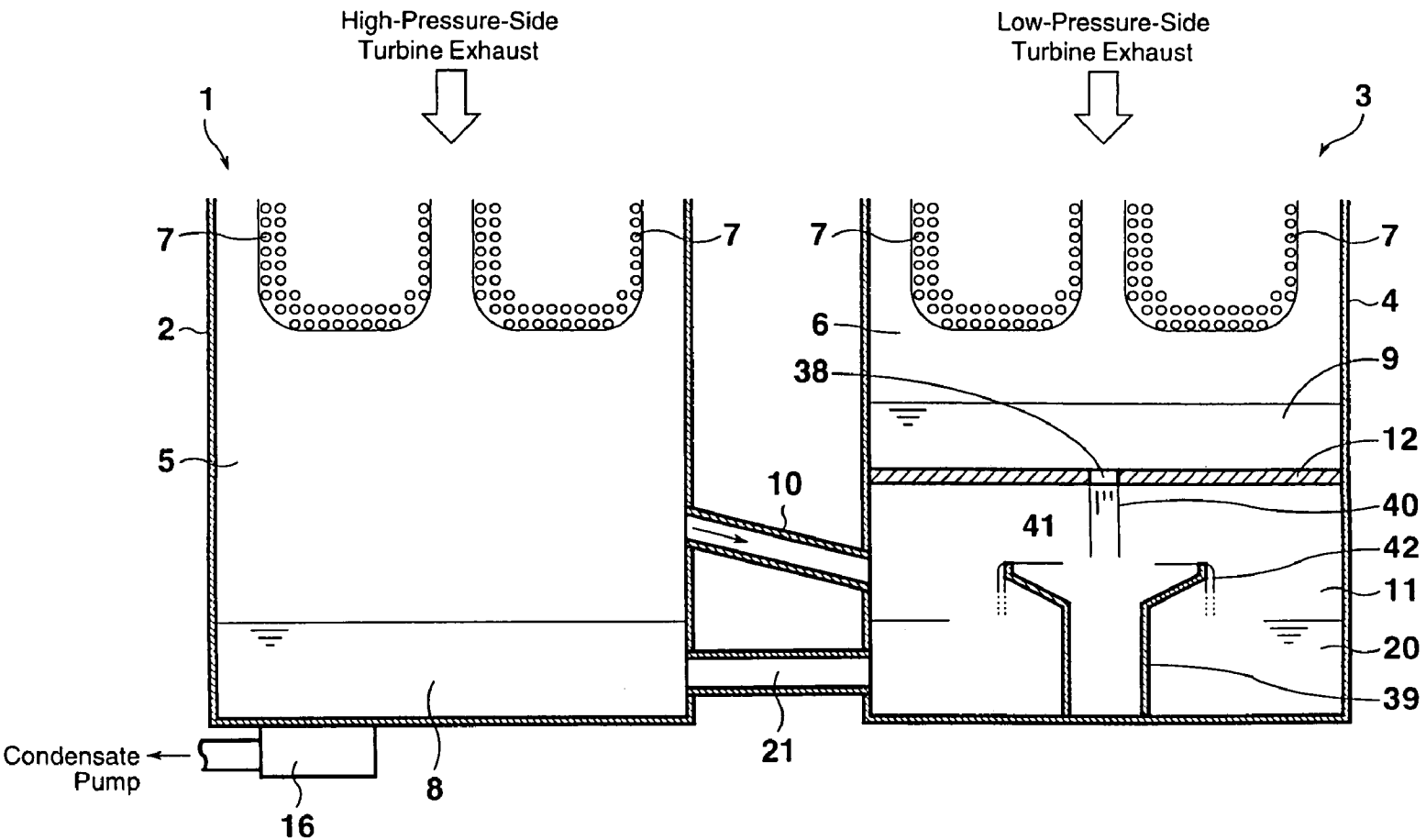
FIG. 9 is a sectional view showing the schematic configuration of a multistage pressure condenser according to a seventh embodiment of the present invention.

A seventh embodiment of the present invention will be described with reference to FIG. 9. FIG. 9 shows a section depicting the schematic configuration of a multistage pressure condenser according to the seventh embodiment of the present invention. The same members as the members shown in FIG. 3 are assigned the same numerals, and duplicate explanations are omitted.

The multistage pressure condenser shown in FIG. 9 is different from the multistage pressure condenser shown in FIG. 3 in the construction for introducing the low-pressure-side condensate 9 accumulated in the low pressure chamber 6 into the reheat chamber 11, and in the construction for causing a circulating flow to the condensate 20 accumulated in the reheat chamber 11. That is, the pressure barrier 12 is provided with a flow-through hole 38 (or a slit) through which the low-pressure-side condensate 9 flows. Moreover, a condensate reservoir 39 for accumulating downflow condensate 40 passing through the flow-through hole 38 is provided in the reheat chamber 11 below the flow-through hole 38. The condensate reservoir 39 has an opening portion 41 at a higher position than the water surface of the condensate 20 accumulated in the reheat chamber 11.

The downflow condensate 40 accumulated in the condensate reservoir 39 produces a circulating flow in its inside, and high-pressure-side steam fed contacts the surface of the accumulated downflow condensate 40 over a wide area, causing surface turbulent heat transfer. The accumulated condensate overflows the condensate reservoir 39, and the resulting downflow condensate 42 falls. The downflow condensate 42 causes a circulating flow to the condensate 20 accumulated in the reheat chamber 11, and the circulating condensate contacts the fed high-pressure-side steam over a wide area, undergoing surface turbulent heat transfer.

The pressure barrier 12 having the flow-through hole 38 may be used, and the condensate reservoir 39 may be provided, in the multistage pressure condensate shown in FIG. 1. Besides, another condensate reservoir may be installed within the condensate reservoir 39 so that the downflow condensate 42 overflows in multiple stages.

Any one or more of the constructions of the above-described embodiments may be applied in suitable combinations according to the scale of the plant and so on.

Figure 10:
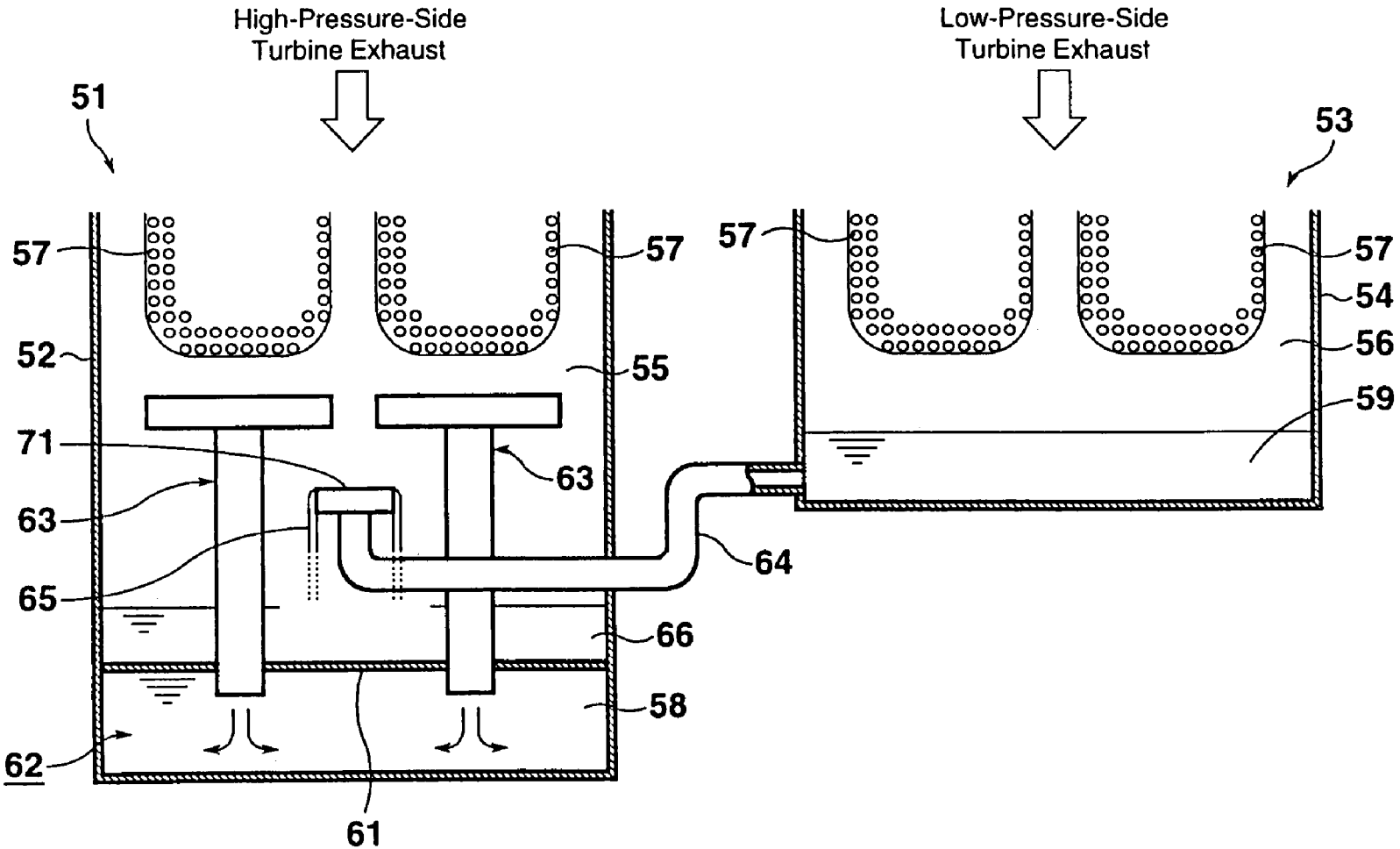
FIG. 10 is a sectional view showing the schematic configuration of a multistage pressure condenser according to an eighth embodiment of the present invention.

An eighth embodiment of the present invention will be described with reference to FIG. 10. FIG. 10 shows a section depicting the schematic configuration of a multistage pressure condenser according to the eighth embodiment of the present invention.

A high pressure shell 52 of a high pressure stage condenser 51 is connected to an outlet side for exhaust steam of a high-pressure-side steam turbine, while a low pressure shell 54 of a low pressure stage condenser 53 is connected to an outlet side for exhaust steam of a low-pressure-side steam turbine. A high pressure chamber 55, a chamber on a high pressure side, is formed by the high pressure shell 52 of the high pressure stage condenser 51. Whereas a low pressure chamber 56, a chamber on a low pressure side, is formed by the low pressure shell 54 of the low pressure stage condenser 53. Below the high pressure chamber 55, a second high pressure chamber 62 is formed via a barrier 61.

The high pressure chamber 55 and the low pressure chamber 66 are each provided with cooling water tube nests 57. Cooling water, such as seawater, is fed to each of the cooling water tube nests 57 in the condition shown in FIG. 2. Exhaust steam, which has finished its work in the steam turbine, is fed to the high pressure chamber 55 and the low pressure chamber 56. Then, the exhaust steam is condensed by cooling water flowing in each of the cooling water tube nests 57 to become high-pressure-side condensate 58 and low-pressure-side condensate 59.

Below the cooling water tube nests 57 within the high pressure chamber 55, receiving members 63 are provided for receiving the high-pressure-side condensate 58 and introducing it into the second high pressure chamber 62. The high-pressure-side condensate 58 is transported from the receiving members 63 to the second high pressure chamber 52, and accumulated there. The low-pressure-side condensate 59 is accumulated in a lower portion of the low pressure chamber 56.

An introduction member 64 extending from the lower portion of the low pressure chamber 56 into the high pressure chamber 55 is provided, and an exit portion 71 at the front end of the introduction member 64 is disposed within the high pressure chamber 55. The low-pressure-side condensate 59 accumulated in the low pressure chamber 56 is transported to the exit portion 71 through the introduction member 64. Then, the low-pressure-side condensate 59 overflows the upper surface of the exit portion 71, falls, and builds up as condensate 66 in a lower portion of the high pressure chamber 55. The upper surface of the exit portion 71 of the introduction member 64 is located at a lower position than the lower portion of the low pressure chamber 56, so that the low-pressure-side condensate 59 overflows the opening at the upper surface of the introduction member 64 because of the difference in height, and flows downward in the high pressure chamber 55. Downflow condensate 65, the condensate having overflowed the exit portion 71 of the introduction member 64 and fallen, moves downward while being heated with high-pressure-side steam, and causes a circulating flow to the condensate 66 accumulated in the lower portion of the high pressure chamber 55. As a result, surface turbulent heat transfer occurs on the surface of the condensate 66.

The condensate 66 accumulated in the lower portion of the high pressure chamber 55 and the high-pressure-side condensate 58 accumulated in the second high pressure chamber 62 are mixed in a merger portion (not shown), and transported toward a condensate pump.

With the so configured multistage pressure condenser, exhaust steam having finished its work in the steam turbine is fed into the high pressure chamber 55 and the low pressure chamber 56, and the exhaust steam is condensed by the cooling water tube nests 57. The high-pressure-side condensate 58 condensed in the high pressure chamber 55 is transported from the receiving members 63 to the second high pressure chamber 62, and accumulated there. The low-pressure-side condensate 59 condensed in the low pressure chamber 56 is accumulated in the lower portion of the low pressure chamber 56, and transported toward the high pressure chamber 55 through the introduction member 64. The low-pressure-side condensate 59 fed through the introduction member 64 overflows the exit portion 71, falls as downflow condensate 65, and accumulates as condensate 66 in the lower portion of the high pressure chamber 55. Since the downflow condensate 65 falls in high-pressure-side steam in the high pressure chamber 55, it is heated by convection heating. The downflow condensate 65, i.e., the condensate overflowing the upper surface of the exit portion of the introduction member 64 and falling, causes a circulating flow to the condensate 66 accumulated in the high pressure chamber 55. The circulating condensate 66 contacts the high-pressure-side steam in the high pressure chamber 55 over a wide area, causing surface turbulent heat transfer.

By these actions, the low-pressure-side condensate 59 is subjected to convection heating while overflowing in the high-pressure-side steam within the high pressure chamber 55, and to surface turbulent heat transfer due to the circulating flow of the condensate 66 caused by the downflow condensate 65 falling after overflowing. As a result, satisfactory heat transfer takes place to raise the temperature of the condensate efficiently. Consequently, heating is carried out efficiently. That is, heating of the low-pressure-side condensate 59 is performed sufficiently, with the space for falling being minimized for compactness. Hence, it becomes possible to construct a multistage pressure condenser permitting compactness and increased efficiency of a power plant.

Besides, the upper surface of the exit portion 71 of the introduction member 64 is disposed at a lower position than the lower portion of the low pressure chamber 56 to make the low-pressure-side condensate 59 overflow the opening at the upper surface of the introduction member 64 owing to the difference in height. However, it is possible to provide pressure-feed means for pressure-feeding the low-pressure-side condensate 59. The provision of the pressure-feed means increases the degree of freedom of installing the high pressure stage condenser 51 or the low pressure stage condenser 53 and lessens the restriction on the installation space.

While the present invention has been described in the foregoing fashion, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the appended claims.

What is claimed is:

1. A multistage pressure condenser having a plurality of chambers at different pressures and adapted to merge and pressure-feed condensates accumulated in the plurality of chambers, the condenser comprising:

a reheat chamber, partitioned off with a pressure barrier in a lower portion of a low pressure chamber, as the chamber on a low pressure side, for introducing and accumulating low-pressure-side condensate;

high pressure steam introduction means for introducing high pressure steam within a high pressure chamber, as the chamber on a high pressure side, into the reheat chamber;

low pressure condensate introduction means for introducing low pressure condensate into the reheat chamber; and circulating flow generation means for generating a circulating flow in the condensate in the reheat chamber to cause surface turbulent heat transfer to promote heat transfer to the condensate by high-pressure-side steam, wherein the circulating flow generation means is constituted such that a flow-through slit, through which the low-pressure-side condensate flows downward, is provided in the pressure barrier, and the circulating flow is generated in the condensate of the reheat chamber by the low-pressure-side condensate which flows downward through the flow-through slit, with a reverse flow thereof being suppressed.

2. The multistage pressure condenser of claim 1, wherein the flow-through slit has a length-to-width ratio of 5 or more.

3. The multistage pressure condenser of claim 1, wherein the low-pressure-side condensate flow downward through the flow-through slit is a film flow.

4. A multistage pressure condenser having a plurality of chambers at different pressures and adapted to merge and pressure-feed condensate accumulated in the plurality of chambers, the condenser comprising:

a reheat chamber partitioned off by a pressure barrier into a lower portion of a low-pressure chamber for introducing and accumulating low-pressure-side condensate;

a high pressure steam introduction device configured to introduce high-pressure steam within a high-pressure chamber into the reheat chamber;

a low-pressure condensate introduction device configured to introduce low-pressure condensate into the reheat chamber; and a flow-through slit configured to generate a circulating flow in the condensate in the reheat chamber to cause surface turbulent heat transfer to promote heat transfer to the condensate by high-pressure-side steam, the flow-through slit, through which the low-pressure-side condensate flows downward, is disposed in the pressure barrier, wherein the circulating flow generated in the condensate of the reheat chamber by the low-pressure-side condensate flowing downward through the flow-through slit without a reverse flow is in the form of a film flow.

5. The multistage pressure condenser of claim 4, wherein the flow-through slit has a length-to-width ratio of 5 or more.

* * * * *